US005957303A

United States Patent [19]

Krenzler

[11] Patent Number: 5,957,303

[45] Date of Patent: Sep. 28, 1999

[54] GOLD PAN WITH WATER DELIVERY CUPS

[76] Inventor: Leo M. Krenzler, 19950 Pacific Hwy. S., Suite 202, Seattle, Wash. 98188

[21] Appl. No.: 08/961,588

[22] Filed: Oct. 31, 1997

Related U.S. Application Data

[60] Provisional application No. 60/029,861, Nov. 1, 1996.

[51] Int. Cl.[6] ..... B03B 5/04

[52] U.S. Cl. ..... 209/434; 209/444; 209/506; 209/453

[58] Field of Search ..... 209/440, 448, 209/434, 444, 451, 452, 453, 506

[56] References Cited

U.S. PATENT DOCUMENTS

| | | | |
|---|---|---|---|
| 1,081,421 | 12/1913 | Arnold . | |
| 1,985,513 | 12/1934 | McCleery . | |
| 1,985,514 | 12/1934 | McCleery | 209/444 |
| 1,986,778 | 1/1935 | Hinkley | 209/452 |
| 4,008,152 | 2/1977 | Kleven | 209/434 |
| 4,389,308 | 6/1983 | Cleland | 209/444 |
| 4,406,783 | 9/1983 | Cleland | 209/444 |
| 5,273,165 | 12/1993 | Krenzler | 209/434 |
| 5,275,294 | 1/1994 | Krenzler | 209/434 |
| 5,788,293 | 8/1998 | Krenzler | 209/434 |

FOREIGN PATENT DOCUMENTS

| | | | |
|---|---|---|---|
| 317422 | 12/1971 | U.S.S.R. | 209/451 |
| 391861 | 1/1974 | U.S.S.R. | 209/452 |

OTHER PUBLICATIONS

Article—"How to soup up your Gold Magic, Panning machine and make it faster than a speeding bunny." By George "Yogi" Houchens, Sacramento CA.

Advertisement—"Desert Fox Gold Panning Machine" by Camel Mining Products, P.O. Box 3179, Quartzsite AZ 85345.

*Primary Examiner*—William E. Terrell
*Assistant Examiner*—Joe Dillon, Jr.
*Attorney, Agent, or Firm*—Delbert J. Barnard

[57] ABSTRACT

A plurality of water cups (80) are mounted at the outer periphery of a rotating gold pan (12). In use, the gold pan (12) is supported in a rearwardly leaning position with a lower edge portion in water. During rotation of the gold pan (12), the water cups (80) collect water as they rotate into and through the water. The water cups (80) lift the collected water as they rotate up out of the water. The water cups (80) release water that they carry into the gold pan (12). The released water helps separate gold particles from other particulate material and moves substantially clean gold particles along the valleys (69) of the bottom wall (52) of the gold pan (12) to a hub cup (54).

7 Claims, 5 Drawing Sheets

FIG. 1
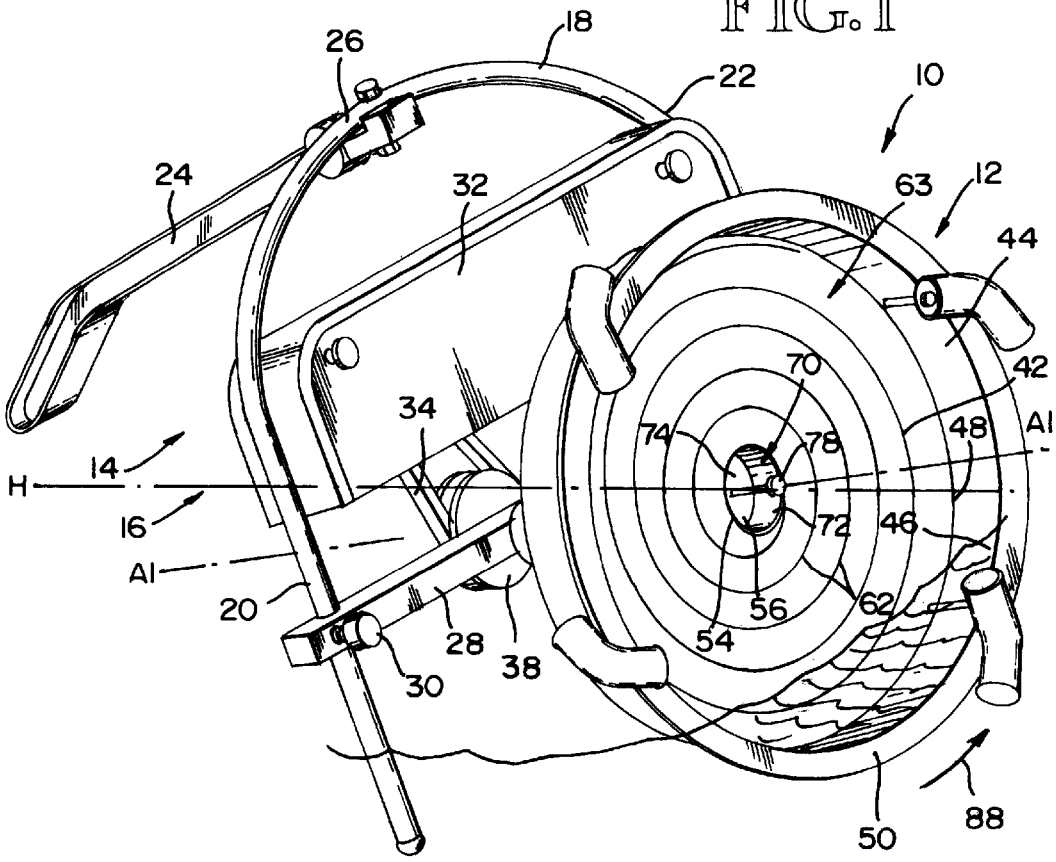
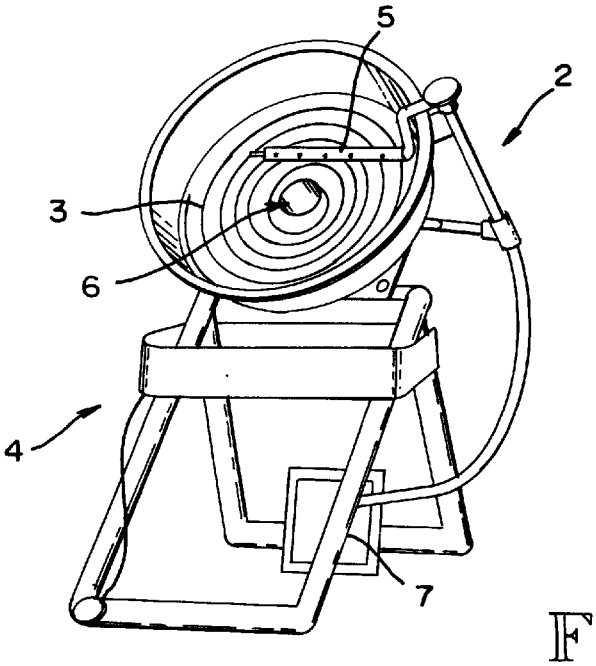
FIG. 2
PRIOR ART

FIG. 8
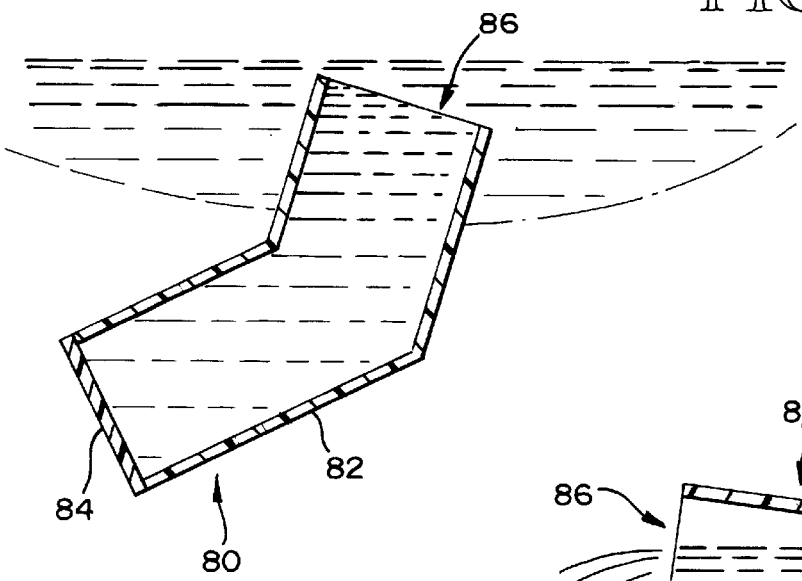
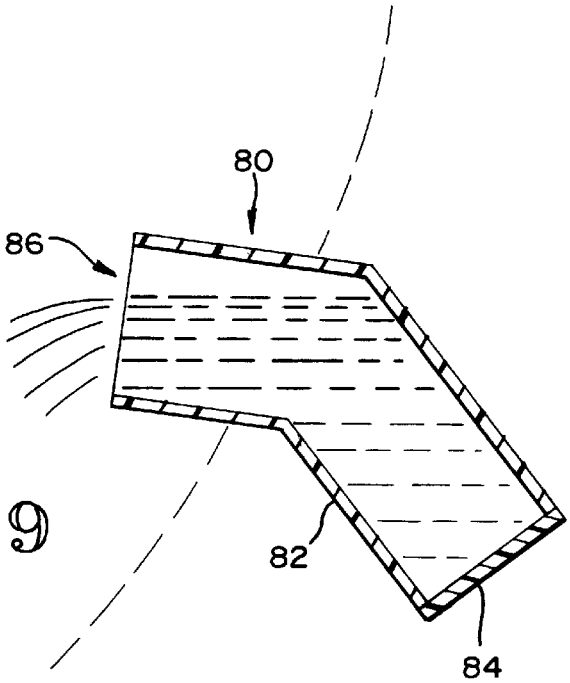
FIG. 9
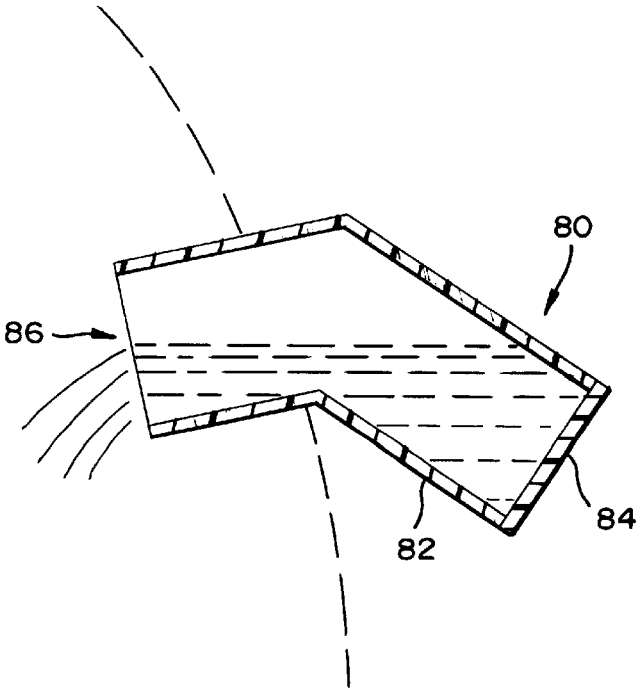
FIG. 10

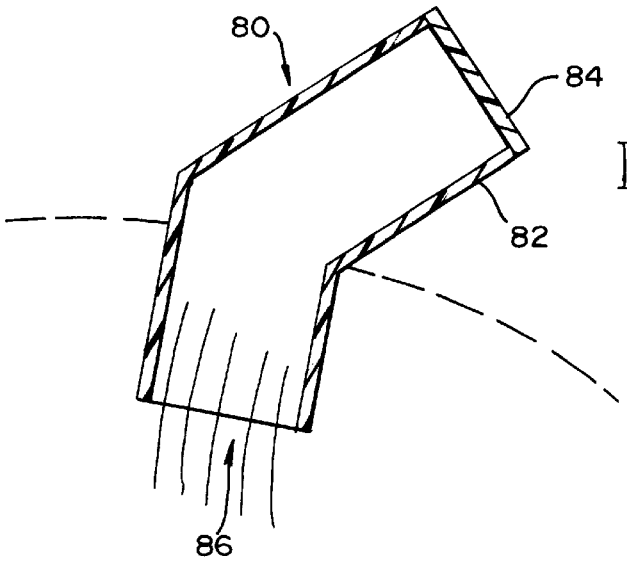
FIG. 11
FIG. 12
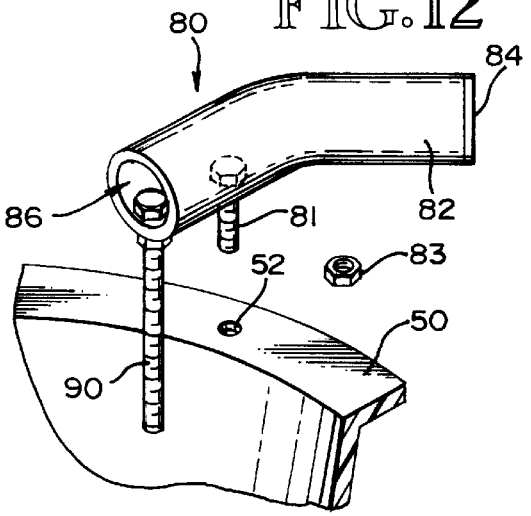
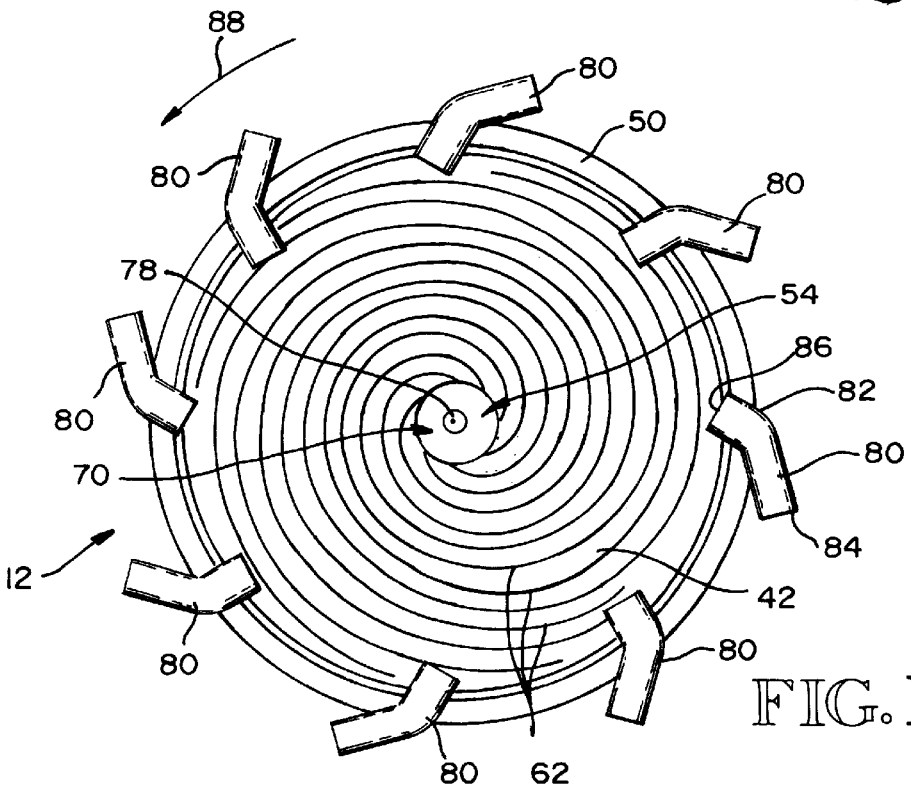
FIG. 13

GOLD PAN WITH WATER DELIVERY CUPS

This application claims priority to U.S. provisional patent application Serial No. 60/029,861, filed Nov. 1, 1996 and is the conversion of that provisional application to a full U.S. application under 35 U.S.C. § 111(a).

TECHNICAL FIELD

The present invention relates to wet gold panning for separating gold particles and ore from black sand. More particularly, the present invention relates to a gold pan separator having a pan with an outer rim that supports a plurality of spaced-apart water delivery cups that, during pan rotation, spills water into the pan's inner surface for greater gold particle recovery.

BACKGROUND OF INVENTION

It is an object of the present invention to utilize the advantages to be gained from the fact that gold is heavier than most other material it may be found with, and from the fact that fine gold particles tend to float and clump together on the surface of water. It is estimated that between 80 to 90% of all gold can be found in the form of gold dust or "flour gold" (microgold). The recovery of these fine gold particles is where the greatest potential exists for gold-panners.

A known method of retrieving more fine gold from a motorized gold pan is by adding a secondary motor and pump in order to provide a fine spray wash across the pan and spiral rib while the pan is rotating, such as shown in prior art view FIG. 2. In this manner, the heavier gold tends to climb the spiral rib faster and move into the center of the pan where it empties into a collector (or catch) cup external of the pan along with other non-gold particles.

This method has not always been successful in that the pump provides a continuous spray that does not always allow fine flour gold and heavier small nuggets to climb up and over the spiral rib and through the hole into the collector pan because the water spray never ceases. Additionally, in applications where the water is dirty, the pump can clog up fairly quickly. Also, the addition of the second pump motor makes the gold pan more expensive because it requires an additional motor and a pressure pump to provide this spray wash. The panning apparatus, including this secondary motor and power supply, becomes heavier to carry to remote prospecting areas, which becomes a disadvantage.

Moreover, the external cup has been undesirable as the external cup may tip over and lose valuable contents. Also, the contents will still need to be further separated to obtain relatively pure gold.

DISCLOSURE OF THE INVENTION

The present invention is directed to an improvement of a separator for separating gold particles from gold ore. The separator includes a rotatable separator pan having a bottom wall, a side wall, and a rim that is mounted adjacent the side wall. The bottom wall and the side wall define an inner surface of the pan, beginning at the side wall adjacent the rim and culminating at a recessed hub cup at the center of the bottom wall. The pan further includes a spiraling surface having at least one spiral riffle spiraling inwardly on the bottom wall of the pan creating loops that spiral inwardly to the hub cup.

The separator also includes a mounting frame for mounting the pan for rotation about an axis that extends axially through the hub cup at an angle from horizontal.

Each spiral riffle further comprises a thin wall extending outwardly from the pan's inner surface. A track is formed on each loop at the lowest portion of the intersection of each riffle wall and the pan's inner surface.

The rim includes a plurality of spaced-apart water delivery cups that are positioned along the rim. Each said water delivery cup includes an opening to receive and release water into the pan's inner surface during rotation of the pan.

During rotation, at least a portion of the pan enters a body of water below the axis such that each water delivery cup collects water. When the pan rotates above the axis, each water delivery cup releases the collected water into the pan's inner surface to provide pulsating water spill directed toward the pan's inner surface.

Also, in use, gold ore containing at least some gold particles is introduced into the pan. The pulsating water spill delivered by the water delivery cups aids in separating the gold particles from the gold ore and concentrating substantially clean gold particles into the hub cup.

In preferred form, each water delivery cup includes a 45° angle, thereby extending the release of the water from the water delivery cups during the rotation. There may be four to eight delivery cups equally spaced-apart along the rim. However, four is the preferred number.

Each water delivery cup may be bolted to the rim. In preferred form, each water delivery cup is pivotally attached to the rim in order that the user may adjust how fast and where the water contents spill. Generally, the water spill is directed toward the hub cup.

According to another aspect of the present invention, the separator further comprises a removable insert cup having a side wall and a planar bottom wall. The insert cup is of a size and shape to be frictionally received within the hub cup for the collection of the substantially clean gold particles. The insert cup may include a handle for removing the insert cup from the hub cup. The insert may include a flat rim or a tapered side wall in which to frictionally engage the hub cup.

According to another aspect of the present invention, the preferred separator pan includes multiple spiral riffles forming multiple points of entry leading into the hub cup. In this manner, more gold ore and gold ore particles may enter the pan and more quickly ascend to the hub cup.

In yet another embodiment, each water delivery cup may include a bolt that extends downwardly from the rim into the pan's inner surface adjacent the side wall and acts to further agitate the water inside the pan's inner surface during rotation.

The advantages of the present invention include 1) a system for providing pulsating water spill inside the pan's inner surface to produce substantially clean gold inside the hub cup without the need for a pump, a secondary motor, or a spray bar; 2) an insert cup in which to easily access the collected gold particles as opposed to refiltering captured gold particles and black sand from a catch cup external the separator pan; 3) an additional agitating means to further collect fine gold particles that collect on the surface tension of the body of water; and 4) a means to control the speed and placement of the water spill.

These and other advantages, objects, and features will become apparent from the following best mode description, the accompanying drawings, and the claims, which are all incorporated herein as part of the disclosure of the invention.

BRIEF DESCRIPTION OF THE DRAWING

In the drawing, like reference numerals are used to indicate like parts throughout the various figures of the drawing, wherein:

FIG. 1 is a pictorial view of the improved separator of the present invention disclosing a rotatable separator pan including a plurality of water delivery cups, an insert cup, a frame, and a drive unit to rotate the separator pan about an axis;

FIG. 2 is a pictorial view of the prior art showing a spiral separator pan, a frame, a spray bar, a pump, additional pump motor, and external catch cup;

FIG. 8 is a sectional view of a water delivery cup collecting water during rotation at the 6:00 o'clock position taken substantially along 8—8 of FIG. 5;

FIG. 9 is a view like FIG. 8, except that the pan has rotated such that the cup is at the 4:00 o'clock position;

FIG. 10 is a view like FIG. 9, except that the cup is in the 2:00 o'clock position;

FIG. 11 is a view like FIG. 10 except that the cup is in the 1:00 o'clock position;

FIG. 12 is a pictorial view of a water delivery cup being pivotally mounted onto the rim of the separator pan, the water delivery cup also including an agitator extending downwardly from the open end of the cup and extending into the separator pan interior; and FIG. 13 is an alterative embodiment of the separator pan shown with eight water delivery cups mounted to the rim.

BEST MODE FOR CARRYING OUT INVENTION

Figure 3:
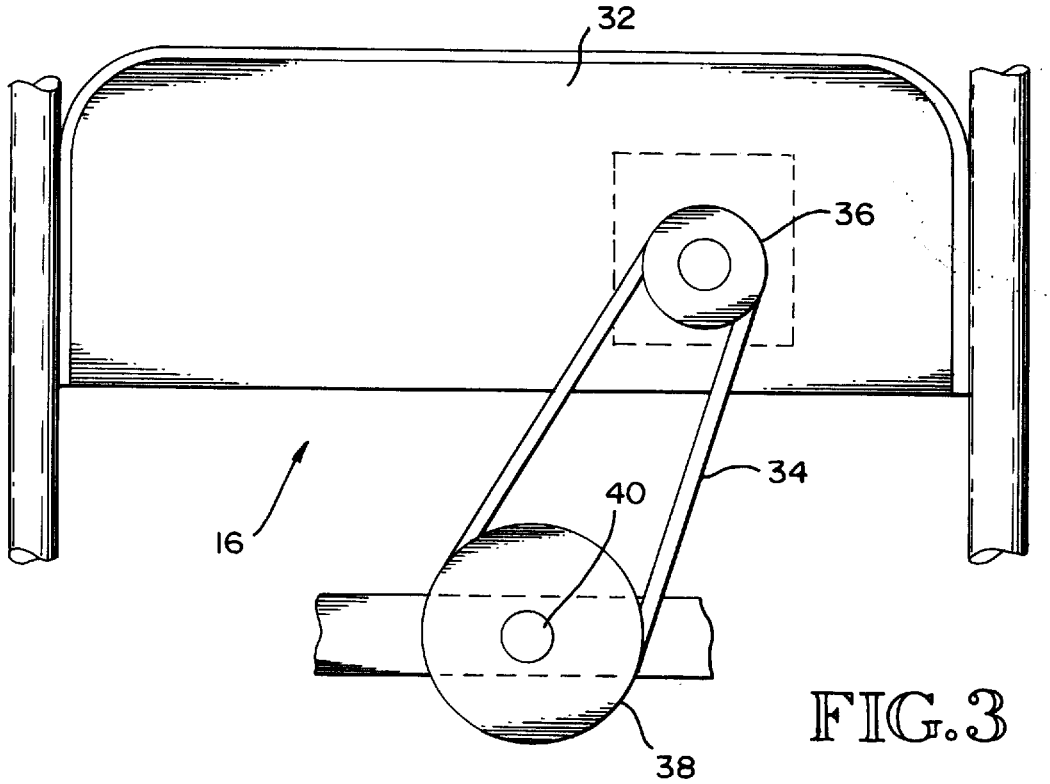
FIG. 3 is a rear view of the frame showing the shortened belt, pulleys, and axle.
Figure 7:
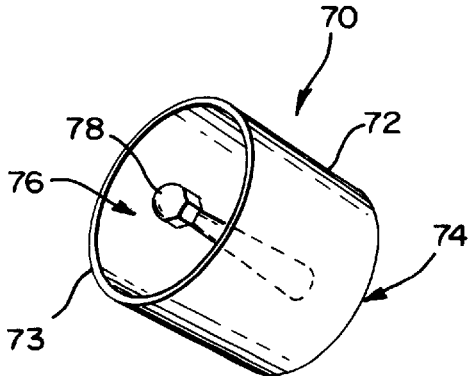
FIG. 7 is a pictorial view of an alternate embodiment of the insert cup with a flared rim.

Referring to FIG. 1, the improved gold pan assembly 10 of the present invention is an improvement over that of the prior art, as shown in FIG. 2. The prior art gold pan system 2 is characterized as having a spiral separator pan 3, a frame 4, and a spray bar 5. The spray bar 5 sprays out a continuous spray of water directed to the pan's inner surface and the open center 6 of the pan 3. A separate pump 7 and a power source (not shown) must provide the water and power for the spray bar to function. A separate collector pan or catch cup (not shown) is external to the rear of the pan and external of the open center to catch gold particles, as well as black sand.

As shown in FIG. 1, the present invention is basically characterized by a rotatable separator pan 12, a pan-mounting frame 14, and a drive unit 16 for rotating separator pan 12 about an axis A1. Frame 14 and drive 16 may be like those described in my U.S. Pat. Nos. 5,273,165 and 5,275,294, both entitled "Rotating Gold Pan For Separating Gold Particles From Ore." Generally, frame 14 includes a U-shaped frame piece 18 that has a pair of legs 20, 22, and a third rear support leg 24. Rear leg 24 is angularly adjustable relative to the U-shaped frame piece 18 by means of adjustment mechanism 26, similar in principle to that shown in my aforementioned U.S. Pat. No. 5,275,244. A cross brace 28 extends between legs 20, 22 of U-shaped frame piece 18. The cross brace 28 is secured to the U-shaped frame piece 18 via a pair of adjustable set screws 30 (only one shown). However, other frames may be used as well.

Referring also to FIG. 3, an elongated housing 32 houses some of the drive components of drive unit 16, as disclosed in my aforementioned U.S. Pat. No. '294. A drive belt 34 extends downwardly from drive unit 16 and rotates on an axle around a first pulley 36 and a second pulley 38. The drive belt 34 rotates an axle 40, through which axis A1 extends, and on which the separator pan is mounted and about which it rotates. The drive components within housing 32 may be like those discussed in more detail in my '294 patent, except that second pulley 38 is larger than that disclosed in the second pulley of the '294 patent, and that drive belt 34 is longer than that described in the '294 patent in order to slow the rotational speed of the separator pan. The rotational speed is roughly in the range of one third the speed of my '294 patent (approx. 6 rpm).

Referring to FIGS. and 6A 4–6, the separator pan 12 of the present invention, however, is not like that of my aforementioned U.S. patents. Here, separator pan 12 includes a bottom wall 42, a side wall 44 having a top edge 46 and a bottom edge 48. The bottom edge 48 is connected to pan bottom wall 42. A rim 50 is mounted generally perpendicularly to top edge 46. Rim 50 may include a plurality of circular openings 52 to receive bolts that will affix a water delivery cup onto the rim (to be discussed below).

Figure 4:
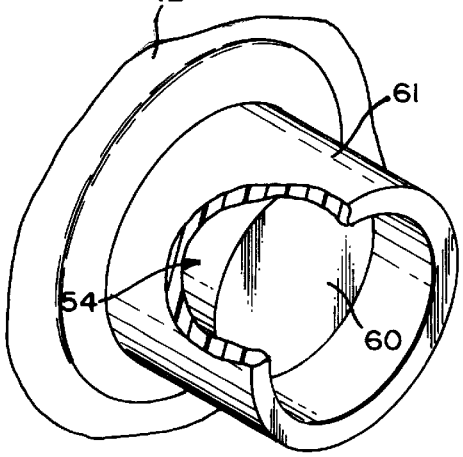
FIG. 4 is a fragmentary pictorial view of the rear portion of the separator pan disclosing a tubular sleeve that mounts to the axle.

A recessed hub cup 54 is formed at the center of pan bottom 42. Hub cup 54 has an open forward end 56 where the hub cup intersects pan bottom 42, a tubular side wall 58, and a closed end 60. As shown in FIG. 4, a tubular sleeve 61 surrounds hub cup 54 on the rear of pan 12. This sleeve 61 mounts onto axle 40.

Figure 5:
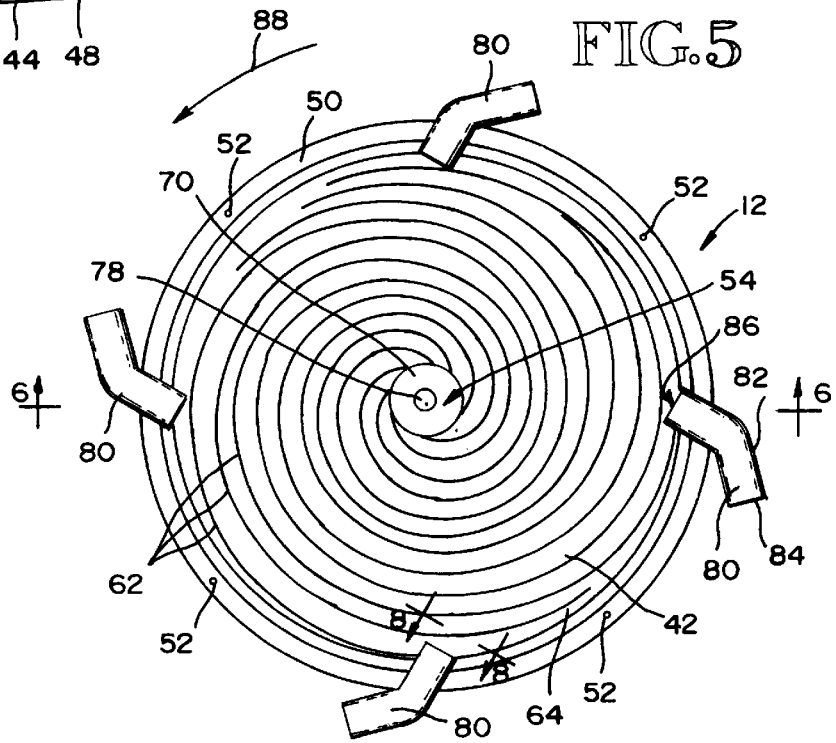
FIG. 5 is a plan view of the separator pan having four spaced-apart water delivery cups mounted on a rim around the perimeter of the separator pan, and showing the insert cup (with flared side walls) inserted into the hub cup, and with the insert cup shown removed in phantom.

Inside separator pan 12 is an inner surface 63, which is defined by the bottom wall 42 and the side wall 44. A plurality of side-by-side spiral ribs, or riffles, 62 forms a spiral surface on inner surface 63. Each riffle 52 is positioned on inner surface 63 beginning at the bottom edge 48 of side wall 44 and radially spiraling inward to create loops that follow a spiral path, which culminates at hub cup 54. Thus, multiple points of entry (shown at 64 in FIG. 5) provide access to pan bottom 42 along riffles 62. The spiral path of the plurality of the spiral ribs 62 from the multiple points of entry 64 culminates at the hub cup 54 and moves in the same direction as the motor. Hence, to be consistent with the drive unit and motor as disclosed in the '294 and '165 patents, the spiral path would be rotating in a counter-clockwise direction, as shown by arrow 88.

Each spiral riffle 62 is comprised of a thin wall 67, which includes a radially inwardly-directed surface 66. Each spiral riffle 62 also includes a radially outwardly-directed surface 68 that slopes outwardly and downwardly from the inwardly-directed surface 66. A track 69 is formed at the lowest portion of the intersection of each riffle wall 67 and the pan's inner surface 63. It is this track that the gold particles travels in order to be separated from the gold ore and to concentrate into the hub cup.

Referring to FIGS. 1, 6, 6A and 7, a removable insert cup 70, such as of the type disclosed in my U.S. Pat. No. 5,788,293, issued Aug. 4, 1998, is received into hub cup 54 in order to access the filtered gold particles easily during separation. Insert cup 70 includes a tubular side wall 72, a planar bottom wall 74, an open end 76, and a center post or handle 78, which is formed as part of insert cup 70. Handle 78 is used for removing and replacing insert cup 70 into and out from hub cup 54. Tubular side wall 72 includes a flared rim 73 (FIG. 7) or, alternatively, a tapered side wall (FIG. 6) to provide a frictional engagement of insert cup 70 into hub cup 54. This frictional engagement maintains insert cup 70 within hub cup 54 during rotation of the separator pan 12. The inclusion of a closed-end hub cup and the flared wall insert cup 70 is an improvement over the prior art in that the prior art has an open-ended hub cup that empties both gold particles and non-gold particles into a receptacle in which the contents have to be additionally hand panned to sift out the flour gold from the non-gold particles.

Referring to FIGS. 5–6, 8–13, one of the main improvement of the present invention is the addition of a plurality of water delivery cups 80 having a tubular side wall 82, a closed end formed by and end wall 84, and an open end 86, thus forming an inherent opening in which water can be received into and released (spilled) from. Each water delivery cup 80 is mounted to rim 50 via a bolt 81 (FIG. 10) that is received into tubular side wall 82 and into circular opening 52 on rim 50. A lock nut 83 threads a bolt 81 to abut rim 50 and secure cup 80 to rim 50.

Each water delivery cup 80 is pivotally bolted to rim 50 such that its open end 86 is adjustably directed inwardly of pan 12 at various angles by the prospector for reasons that will be discussed further below. In preferred form, each cup 80 is a 1" diameter PVC 45° elbow that provides two functions. First, the angle on the side wall maintains the compact size of the gold pan as the cups do not need to extend outwardly of the rim to a great degree. Second, the angle of the elbow provides a method of releasing the water contents (to be discussed below) at various times over the rotation of the pan. However, the present invention adequately functions with straight side wall cups, as well. In preferred form, there are four water delivery cups 80 that are mounted relatively equi-distantly spaced-apart on separator pan rim 50. However, any number will work. An alternate number of cups (eight) are shown generally equi-distant on the pan rim in FIG. 13.

In use, the gold pan 10 is positioned within a stream or other shallow bed of water. During rotation of the pan, a portion of the pan and its side wall below the axis A1 (as best shown in FIG. 1) is immersed in the water. During rotation, each water delivery cup collects water when the water delivery cup is in the water. The cup will empty (spill) its water contents when above the axis A1 through the force of gravity into and over the pan's inner surface and onto the spiral riffles. FIG. 8 shows a cup in the 6:00 o'clock position filled with water. At the 4:00 o'clock position (FIG. 9), the water is pouring out of the cup. By the 2:00 o'clock position (FIG. 10), the cup is beginning to empty with a full stream spilling out. At the 1:00 o'clock position (FIG. 11), the cup is nearly empty and will rotate around to collect water again at approximately the 7:30 o'clock position. As there are preferably four spaced-apart cups, there is a gentle pulse of water that continually, but intermittently, washes over the pan's inner surface and spiral riffles. This means there is a brief time when water from the cups does not fall onto the pan's inner surface. The benefit of this process will be discussed further below.

Referring again to FIG. 1, during wet panning operation, separator pan 12 is rotated in the direction of arrow 88 as gold ore, dirt, sand, and other debris (hereinafter referred to as "gold ore" and not shown) is introduced into separator pan 12. As separator pan 12 rotates about axle 40, gold particles move along each spiral riffle 62 inwardly along pan bottom 42 and along the spiral path into insert cup 70 of hub cup 54. The gold particles ultimately collect within insert cup 70. Normally, a small amount of non-gold particles also collect into insert cup 70. To improve the chance that primarily gold particles collect in insert cup 70, the pulsing action of the water delivery cups 80 functions to allow the heavier gold particles to spiral up riffles into the insert cup 70. Thus, the insert cup 70 contains substantially pure gold particles, as opposed to the prior art that generally requires resifting. Additionally, no pump, additional motor, or extra wiring is required. The delivery cups provide a lightweight and inexpensive alternative to the steady stream pump, which may clog, during use.

Additionally, during wet panning operations, fine gold particles tend to cling to the inwardly-directed surface 66 and rotate around with the separator pan 12. As the fine gold particles contact the water surface of the spiral rib during rotation, the fine gold particles tend to displace from the inner surface and begin to float on the water surface. The pulsing water spills the fine gold particles upwardly as they clump together to sink into track and up to the hub cup. Between alternate spills from the water delivery cup, the wet riffles in the wet pan continue to deliver fine gold that would otherwise wash away by the spray bar of the prior art.

The benefit of pivotally mounting the water delivery cups is that each cup may be adjusted in accordance with the environment and conditions at the time of prospecting. For example, all cups may be angled at the same angle as measured from the rim to be directed inwardly toward the pan's inner surface. Each water delivery cup will spill faster if the open end of each cup is directed toward the center of the pan 12. If each water delivery cup is adjusted so that the open end is directed more closely to the multiple points of entry, the water is held in the cup longer, spilling later. The prospector may wish to adjust only one or two of the cups relative to the other cups, depending on the type of pulsating water spill the prospector desires.

Figure 6A:
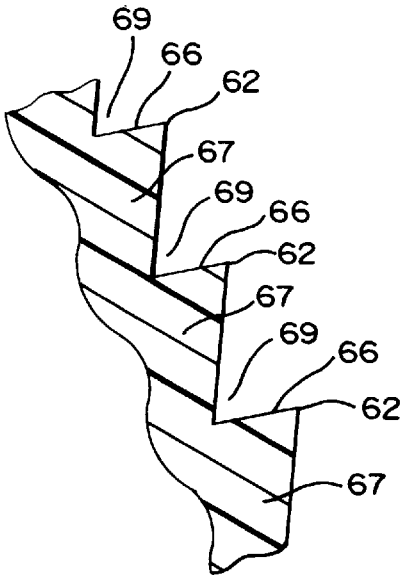
FIG. 6A is an enlarged scale fragmentary view of a portion if the bottom of the pan shown in FIG. 6.
Figure 6:
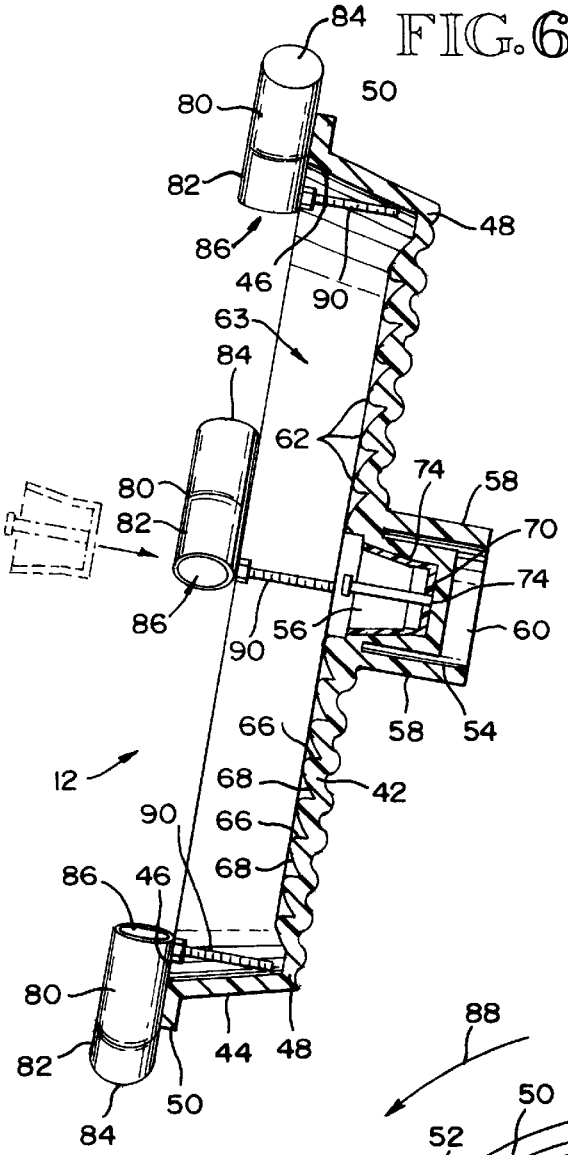
FIG. 6 is a sectional view of the pan and water delivery cups taken substantially along 6—6 of FIG. 5.

Another feature of this invention is better seen in FIGS. 6 and 12, wherein an elongated agitator (bolt) 90 extends downwardly into the pan's inner surface and adjacent the side wall. The bolt extends from the tubular side wall 82 adjacent the open end 86. During rotation, bolt 90 acts to agitate by creating a small amount of water turbulence adjacent side wall 44 to untrap any raw gold particles that clump between pan side wall 44 and pan bottom 42. In this way, the untrapped material can sink in order to readily enter the loops of the spiral riffle. Also, agitator 90 agitates material below the water surface to cause lighter material to be tossed about, while heavier gold particles are moved by the spiral riffle 62 upwardly into insert cup 70 of hub cup 54.

Another benefit of the present invention is that the separator with water delivery cups will adequately function even in dirty water. The prior art pump will clog up in dirty water applications.

All of my aforementioned patents, and provisional application, to which this application claims priority, are hereby incorporated by reference.

It is to be understood that many variations in size, shape, and construction can be made to the illustrated and above-described embodiment without departing from the spirit and scope of the present invention. Some of the features of the present embodiment may be utilized without other features. Therefore, it is to be understood that the presently-described and illustrated embodiment is non-limitive and is for illustration only.

What is claimed is:

1. A separator for separating gold particles from particulate earth material, comprising:

a mounting frame;

a gold pan mounted on said mounting frame for rotation about an axis;

said gold pan having a bottom wall, a side wall projecting from the bottom wall to form a pan interior, and a hub cup at the center of the bottom wall;

ribs on said bottom wall spiraling radially inwardly towards said hub cup and forming radially inwardly spiraling valleys where the ribs meet the bottom wall;

a plurality of tubular water cups mounted at the outer periphery of the side wall, outside of the gold pan, said water cups having generally radially inwardly directed open ends and closed outer ends;

wherein in use the frame is positioned to mount the gold pan in a rearwardly leaning position with a lower edge portion in a body of water and the gold pan is rotated;

wherein during rotation of the gold pan the water cups collect water as they rotate into and through the body of water and lift the collected water as they rotate up out of the body of water and release the collected water into the gold pan after leaving the body of water; and wherein said release of water from the cups into the gold pan will help separate gold particles radially inwardly along the valleys to the hub cup.

2. The separator of claim 1, comprising between four to eight water cups spaced apart along the outer periphery of the side wall.

3. The separator of claim 1, wherein each water cup has an outer end portion, including a said closed outer end, that extends generally tangent to the periphery of the gold pan.

4. The separator of claim 3, further comprising a rim at the periphery of the side wall, and wherein the water cups are bolted to the rim.

5. The separator of claim 1, further comprising a rim at the periphery of the side wall, and wherein the water cups are bolted to the rim.

6. The separator of claim 5, wherein each water cup includes an agitator that extends from the rim and into the pan interior.

7. The separator of claim 6, wherein the agitator is a bolt.

* * * * *